United States Patent [19]

Tannenbaum

[11] Patent Number: 4,837,953

[45] Date of Patent: Jun. 13, 1989

[54] DEVICE FOR DISPLAYING PHOTOGRAPHS AND THE LIKE

[76] Inventor: Ken Tannenbaum, 16 W. 21st St., New York, N.Y. 10010

[21] Appl. No.: 197,110

[22] Filed: May 20, 1988

[51] Int. Cl.[4] ..... G09F 1/10

[52] U.S. Cl. ..... 40/124; 40/600

[58] Field of Search ..... 40/124, 600, 642; 273/148 A, 150; 24/67 R, 67.9, 67.11, DIG. 8; 402/19, 20, 503

[56] References Cited

U.S. PATENT DOCUMENTS

| | | | |
|---|---|---|---|
| 58,270 | 9/1866 | Marks | 40/124 |
| 70,500 | 11/1867 | Averell | 40/124 |
| D. 262,802 | 1/1982 | Ylvisaker et al. | D20/42 |
| 1,634,696 | 7/1927 | Teneau | 273/150 |
| 2,729,452 | 1/1956 | Baumann | 273/150 |
| 2,811,363 | 10/1957 | McDaniel | 273/150 |
| 2,943,246 | 6/1960 | Riordan | 335/285 |
| 2,976,632 | 3/1961 | Phillips | 40/124 |
| 2,977,082 | 3/1961 | Harris | 402/503 |
| 3,620,535 | 11/1971 | Cerney et al. | 273/150 |
| 4,497,125 | 2/1985 | Hutchinson | 40/10 R |
| 4,625,966 | 11/1986 | Sweet | 273/150 |
| 4,630,824 | 12/1986 | Sweet | 273/150 |
| 4,669,733 | 6/1987 | Sweet | 273/150 |
| 4,684,132 | 8/1987 | Wolford | 273/150 |

FOREIGN PATENT DOCUMENTS

| | | | |
|---|---|---|---|
| 7992 | of 1908 | United Kingdom | 273/150 |

*Primary Examiner*—Richard J. Apley
*Assistant Examiner*—J. Welsh
*Attorney, Agent, or Firm*—Jacobs & Jacobs

[57] ABSTRACT

A device for displaying photographs or the like, comprises a sheet-holding assembly comprising first and second plastic members each having a planar face and an outer edge defining the boundary thereof, the members being secured face-to-face to define between the faces an empty slot having an opening extending completely around the edges, the members being so closely spaced as to frictionally engage and secure a photograph or the like having a thickness of a few mils inserted into the slot, and the members being beveled at the opening of the slot to facilitate entry of the photograph or the like into the slot for frictional engagement by the members, and an attachment device for attaching one of the plastic members to a vertical surface with the slot disposed substantially in a vertical plane.

11 Claims, 2 Drawing Sheets

DEVICE FOR DISPLAYING PHOTOGRAPHS AND THE LIKE

The present invention relates to a device for displaying photographs or the like, and in particular it relates to a device that can be attached to a vertical surface such that the photograph is disposed substantially in a vertical plane for viewing.

It is commonplace to attach photographs to the door of a refrigerator or to other suitable vertical surfaces for informal display of the photograph. While convenient, this informal method is far from attractive, and if adhesive tape, tacks or the like is used to secure the photograph to the surface, both the photograph and the surface may become marred by the adhesive.

The present invention provides a device for displaying photographs or like sheet material, which comprises a sheet holding assembly and an attachment means for attaching the assembly to a vertical surface. The sheet holding assembly comprises first and second plastic members, each of which having a planar face and an outer edge defining the boundary of the face. The plastic members are secured together in face to face relationship by means of an adhesive means located interiorly of the outer edges, the members being spaced apart to define between the faces an empty slot means having an opening extending completely around the edges. The members are so closely spaced as to frictionally engage and secure a photograph or the like having a thickness of only a few miles, which is inserted into the slot. The edges of the members are beveled to facilitate the entry of a photograph or the like into the empty slot means for frictional engagement by the members. The present invention also provides an attachment means for attaching one of the members to a vertical surface with the slot means disposed substantially in a vertical plane.

In a preferred embodiment of the invention, the sheet holding assembly consists of two plastic plate members each having front and rear planar faces, the rear faces confronting one another to form the empty slot. In this embodiment, the attachment means attaches the front face of one of the plate members to a vertical surface so that the photograph or the like can be displayed.

In accordance with the present invention, the empty slot formed by the two members extends completely around the perimeter of the members, whereby a photograph or the like can spontaneously inserted into any desired location without any preplanning involved. Moreover, a number of photographs or the like can be inserted into a single assembly, thereby providing means forming a cluster of related photographs that are held together both physically and aesthetically by the assembly.

By providing the plastic members of the assembly in a variety of shapes and colors, a family of attractive and highly functional devices can be provided.

The present invention is illustrated in terms of its preferred embodiments in the accompanying drawings, in which:

FIG. 1 is a plan view of a device according to the invention into which has been inserted a photograph or the like;

Figure 1:
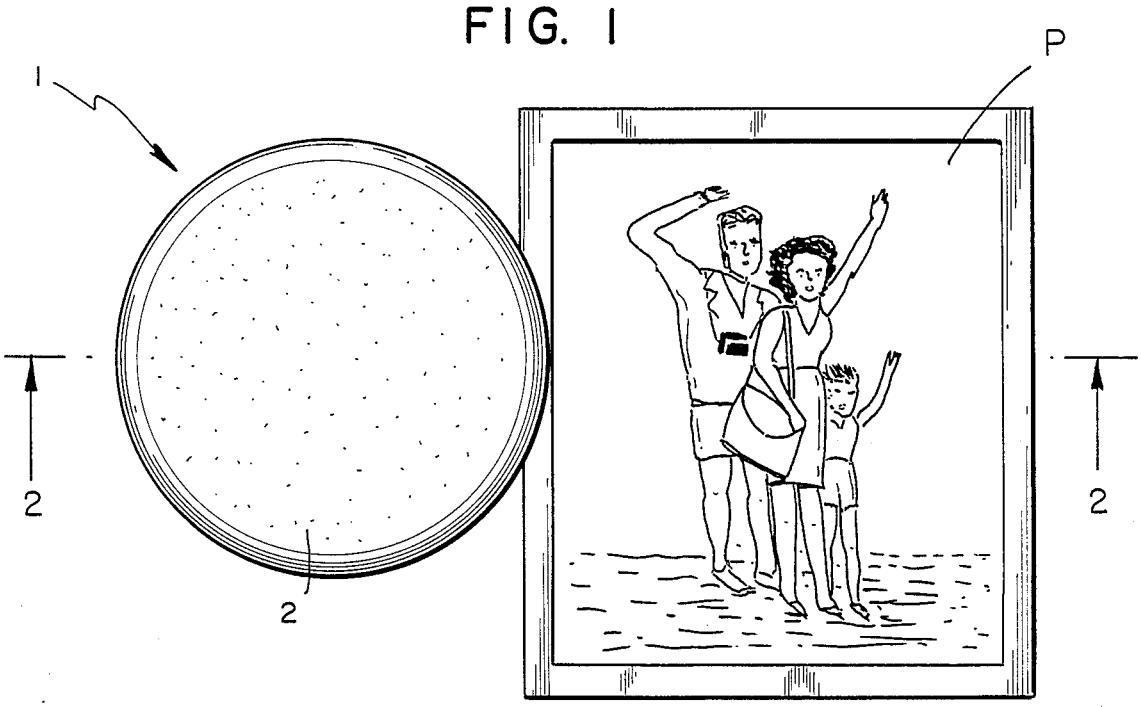
Figure 2:
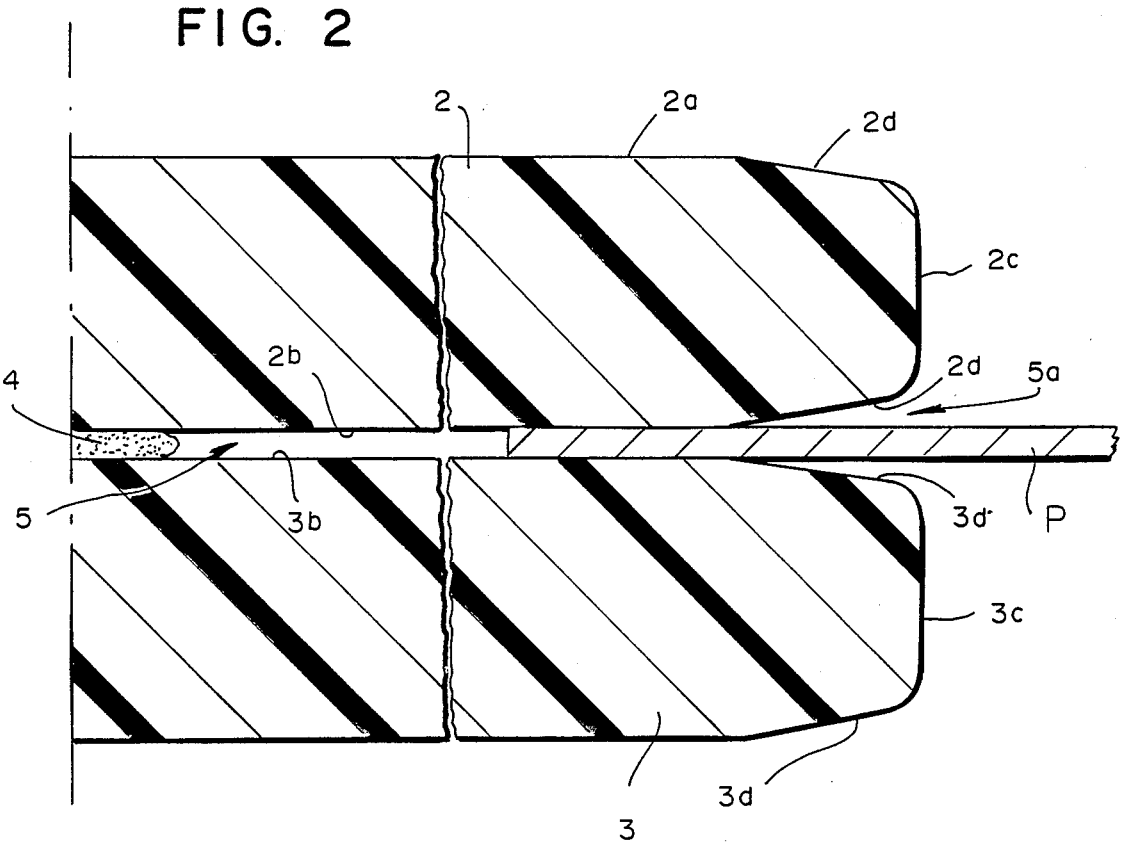
FIG. 2 is an elevational view, in section, taken along lines 2—2 of FIG. 1, and in greatly enlarged scale.

Referring to the drawings, FIGS. 1 and 2 show the device 1 of the present invention, which comprises plastic plate members 2 and 3 having opposed front and rear planar faces *2a,2b,3a,3b* and an outer edge *2c,3c* defining the boundary of the faces of the members 2,3, respectively. As shown, the adhesive means 4, which is located interiorly of the outer edges *2c,3c*, secures the plate members 2,3 together with the rear faces *2b,3b* confronting one another, the plate members 2,3 being spaced apart so as to define between the rear faces *2b,3b* an empty slot 5 having an opening 5a extending completely around the edges *2c,3c*.

The members 2,3 are closely spaced together such that when a photograph P or the like having a thickness of a few mils is inserted into the slot 5, it will be frictionally engaged by the rear faces *2b,3b* of the members 2,3, respectively. To facilitate the entry of the photograph P or the like into the slot 5, the members 2,3 are beveled at least at the opening *5a* of the slot. The beveling *2d,3d* or rounding of the members 2,3 at the intersection of the faces *2a,2b,3a,3b* and the respective edges *2c,3c* may be accomplished by tumbling the plastic members 2,3 so that the intersections become rounded or beveled as shown at *2d,3d* or by molding the members 2,3 (such as by injection molding) to form the beveling in the mold.

The adhesive means 4 that secures members 2,3 together may be a suitable glue or other adhesive that will bond to the rear faces *2b,3b* to secure members 2,3 together. Alternatively, adhesive means 4 may be provided by heat welding, ultrasonic welding or other conventional techniques. In yet another embodiment of the invention, the adhesive means 4 may be provided by applying a solvent to the members 2,3, whereby the members 2,3 are secured together after evaporation of the solvent, all in accordance with known techniques. While any suitable adhesive means 4 may be used, excellent results have been obtained through the use of methylene chloride.

Figure 3:
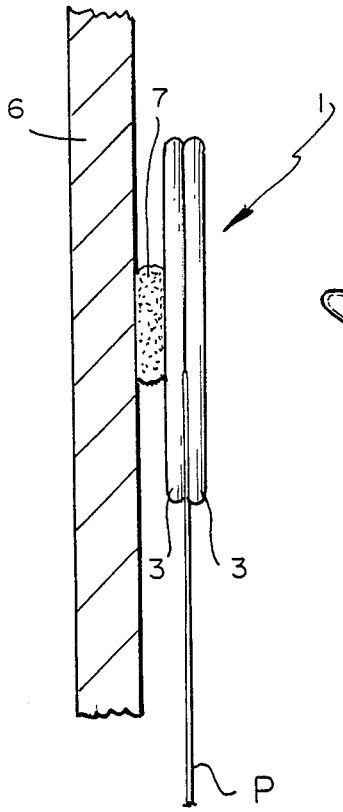
FIG. 3 is an elevational view of a device according to the invention secured to a vertical surface.

Device 1 is used to display a photograph P by pushing the photograph P into the slot 5 until it is frictionally engaged by the members 2,3. Movement of the photograph P will be arrested when the photograph P is securely engaged by the members 2,3. As shown in FIG. 3, the device 1, carrying photograph P, is then attached to a vertical surface 6 by means of the attachment means 7, which in this case is a small mass of a tacky synthetic material. Preferably, the tacky synthetic material will be a tacky, deformable material, such as tacky butyl rubber or other tacky caulking material. Preferably, the tacky synthetic material is Fun-Tak, which is sold commercially by DAP, Inc. As seen in FIG. 3, the device 1 with the photograph P held between members 2 and 3 is attached to the vertical wall 6 with the slot 5 disposed in a vertical plane. Thus, the attachment means 7 must be effective to support the weight of the device 1 and the photograph of photographs P held therein. Preferably, the attachment means 7 is readily removable from the wall 6 to enable the user to move the device 1 to another location and/or to replace the photograph or photographs. However, the attachment means 7 can be double-sided tape or the like, such as used for permanent mounting.

The present invention may take the form of a kit comprising one or more of the devices 1 and a supply of a tacky, deformable material 7.

Figure 4:
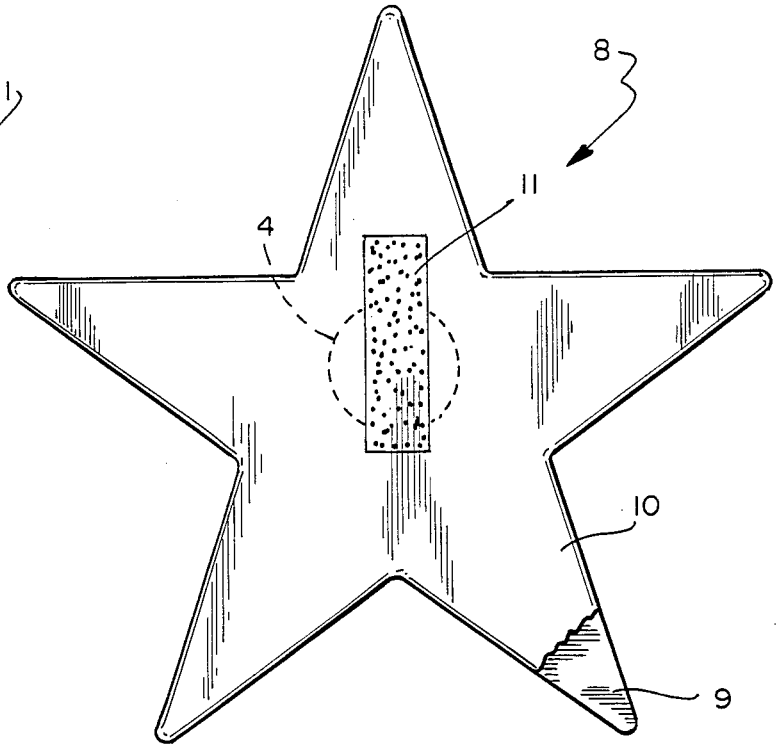
FIG. 4 is an alternative embodiment which is star shaped.

An alternative embodiment of the invention is shown in FIG. 4. In this case, the device 8 is constructed in the same manner as the device 1 and comprises plastic plate members 9 and 10 which are secured together by means of a suitable adhesive means 4 whereby the slot means 5 (not shown) is formed between the confronting rear faces of members 9,10. Attached to the front face of member 10 is a magnet 11, preferably a flat plastic magnet such as is used in refrigerator door gaskets and the like, whereby device 8 can be secured to a vertical magnetic surface, such as the door of a refrigerator or freezer, by means of the magnet 11.

Figure 5:
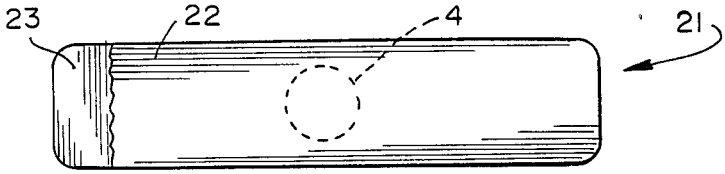
FIGS. 5–7 are plan views of alternative embodiments of the present invention.
Figure 6:
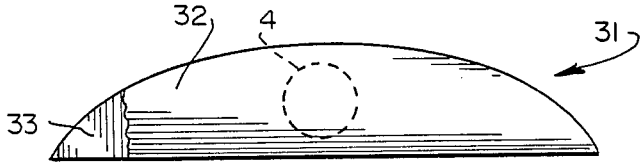
Figure 7:
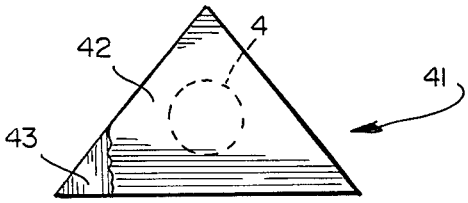

FIGS. 1–4 illustrate the present invention in terms of devices in the form of two congruent circular disks (FIGS. 1–3) or two congruent star shaped plates (FIG. 4). Other shapes are also suitable as shown by devices 21, 31 and 41 in FIGS. 5–7, respectively. In each case, the devices, 21, 31 and 41 employ an adhesive means 4 to secure plastic plates 22,23 or 32,33 or 42,43 together so as to define the narrow slot means 5 (not shown). Devices 21, 31 and 41 are used in combination with a suitable attachment means, such as the tacky deformable material as previously described for attaching the device to a vertical surface as illustrated, for example, in FIG. 3.

I claim:

1. A device for displaying photographs or the like, which comprises:

a sheet-holding assembly comprising first and second plastic members each having a planar face and an outer edge defining the boundary thereof, adhesive means located interiorly of said edges for securing said members together in face-to-face relationship, said members being spaced apart thereby defining between said faces an empty slot means having an opening extending completely around said edges, said members being so closely spaced as to frictionally engage and secure a photograph or the like having a thickness of a few mils inserted into said slot means; said members being beveled at the opening of said slot means to facilitate entry of said photograph or the like into said slot means for frictional engagement by said members; and attachment means for attaching one of said members to a vertical surface with said slot means disposed substantially in a vertical plane.

2. The device according to claim 1, wherein said adhesive means is an adhesive layer bonding said members together.

3. The device according to claim 1, wherein said adhesive means is a solvent- or ultrasonicp-weld.

4. The device according to claim 1, wherein said attachment means is a tacky synthetic material.

5. The device according to claim 1, wherein said attachment means is a magnet secured to one of said members.

6. A device for displaying photographs or the like, which comprises:

a sheet-holding assembly consisting of first and second plastic plate members each having front and rear planar faces and an outer edge defining the boundary of said faces, adhesive means located interiorly of said edges for securing said plate members together with said rear faces confronting one another, said plate members being spaced apart thereby defining between said rear faces an empty slot means having an opening extending completely around said edges, said plate members being so closely spaced as to frictionally engage and secure a photograph or the like having a thickness of a few mils inserted into said slot means; said plate members being beveled at the intersection of the front and rear faces and the associated outer edge to facilitate entry of siad photograph or the like into said slot means for frictional engagement by said plate members; and attachment means for attaching the front face of a said plate member to a vertical surface with said slot means disposed substantially in a vertical plane.

7. The device according to claim 6, wherein said plate members are congruent plates.

8. The device according to claim 6, wherein said adhesive means is an adhesive layer bonding said members together.

9. The device according to claim 6, wherein said adhesive means is a solvent- or heat-weld.

10. The device according to claim 6, wherein said attachment means is a tacky synthetic material.

11. The device according to claim 6, wherein said attachment means is a magnet secured to the front face of a said plate member.

* * * * *